US009021749B2

(12) United States Patent
Poldmaa

(10) Patent No.: US 9,021,749 B2
(45) Date of Patent: May 5, 2015

(54) TEMPORARY ROOF ANCHOR HAVING SHOCK ABSORBING MEANS

(75) Inventor: Arvo Poldmaa, Hawks Nest (AU)

(73) Assignee: H2Flo Pty Ltd, Hawks Nest, New South Wales (AU)

( * ) Notice: Subject to any disclaimer, the term of this patent is extended or adjusted under 35 U.S.C. 154(b) by 100 days.

(21) Appl. No.: 13/604,464

(22) Filed: Sep. 5, 2012

(65) Prior Publication Data

US 2013/0056608 A1 Mar. 7, 2013

(30) Foreign Application Priority Data

Sep. 5, 2011 (AU) ..... 2011903582

(51) Int. Cl.

| | |
|---|---|
| ***E04F 19/00*** | (2006.01) |
| ***E04H 14/00*** | (2006.01) |
| ***A47G 29/02*** | (2006.01) |
| ***A62B 35/04*** | (2006.01) |
| ***E04G 21/32*** | (2006.01) |

(52) U.S. Cl.

CPC ..... *A62B 35/04* (2013.01); *E04G 21/329* (2013.01)

(58) Field of Classification Search

CPC ... E04G 21/239; E04G 21/3276; E04G 13/12; A62B 1/04

USPC ..... 248/237, 560; 52/741.1, 745.06, 52/749.12, 27; 182/45, 36

See application file for complete search history.

(56) References Cited

U.S. PATENT DOCUMENTS

| | | | | |
|---|---|---|---|---|
| 3,444,957 | A * | 5/1969 | Ervin, Jr. | 182/3 |
| 5,113,981 | A * | 5/1992 | Lantz | 188/371 |
| 5,174,410 | A * | 12/1992 | Casebolt | 182/3 |
| 6,085,802 | A * | 7/2000 | Silberberg | 139/387 R |
| 7,665,248 | B2 * | 2/2010 | Blackford | 52/27 |
| 2013/0277519 | A1 * | 10/2013 | Poldmaa | 248/237 |

FOREIGN PATENT DOCUMENTS

| | | |
|---|---|---|
| FR | 2857601 | 1/2005 |
| GB | 964096 | 7/1964 |
| GB | 1536354 | 12/1978 |
| NZ | 238211 | 10/1993 |
| NZ | 590186 | 3/2012 |
| WO | 9529738 | 11/1995 |
| WO | 9737876 | 10/1997 |
| WO | 0146601 | 6/2001 |
| WO | 03047700 | 6/2003 |
| WO | 2010000035 | 1/2010 |

* cited by examiner

*Primary Examiner* — Amy J Sterling
(74) *Attorney, Agent, or Firm* — TraskBritt, P.C.

(57) ABSTRACT

Described is a temporary roof anchor for fitment to a roof support structure, the roof anchor comprising: first attachment means for temporary fitment to the roof support structure; second attachment means remote from the first attachment means for attaching safety equipment; and shock-absorbing means having a deformable region extending between the first and second attachment means in a first length when not subject to a deformation force corresponding to a critical sudden load, the shock-absorbing means lying substantially in a single plane and comprising a substantially rigid structure that, when subject to the critical sudden load, deforms, elongating to a greater length than the first length.

21 Claims, 4 Drawing Sheets

TEMPORARY ROOF ANCHOR HAVING SHOCK ABSORBING MEANS

CROSS-REFERENCE TO RELATED APPLICATION

This patent application claims the benefit of Australian Provisional Patent Application Serial No. 2011903582, filed Sep. 5, 2011, the disclosure of which is hereby incorporated herein in its entirety by this reference.

TECHNICAL FIELD

The application relates to a temporary roof anchor for attaching devices, apparatus or equipment to a roof surface and, more particularly, to a roof anchor for temporary fitment to a roof structure clad with metal sheeting, the roof anchor also including shock-absorbing means.

BACKGROUND

Several solutions have been proposed for providing anchor points on a roof, but these are normally intended for permanent fitment. Such anchor points are made available so that a person working on the roof, for example, can attach himself to the anchor point by means of a rope or cable, etc., so that in the event of a fall, he will be constrained from falling off the roof.

Thus, conventional roof-anchoring devices for permanent fitment require access to the roof support structure such as a batten or rafter. Direct access to the support structure is generally required and involves mounting the roof anchor prior to the application of the external covering of the roof such as tiles, sarking, sheeting or other cladding so that upon application of the external covering to the support structure, the roof anchor extends beyond the external covering. The anchor will, of course, need to be suitably flashed to provide a weather-proofed fitment.

On the other hand, if the external covering has already been applied to the roof support structure, then at least one unit of the external covering, e.g., a single sheet of covering, must be removed to provide access to the roof support structure. Thus, for example, where large units of sheeting form the external covering of the roof, considerable time and effort may have to be expended to remove a single unit to gain access to the roof support structure. Furthermore, there is also a risk that damage to the covering may occur or, more particularly, once it is re-laid, the covering might not properly seal against the elements.

However, the removal of the covering as described above may be impractical or inconvenient. Alternatively, so-called retro-fit systems have been developed that provide a solution for securing a permanent anchor point by using a tool through an access facility, i.e., a relatively small opening, for example, which is then later sealed.

In any event, all of the foregoing solutions have as their basic premise that the anchor is left permanently in place once fitted. This, however, may not be convenient or even desirable having regard to aesthetic considerations and may be unnecessarily wasteful as there may be little need for an anchor point at any time in at least the foreseeable future. Furthermore, anchor points may be desired at various locations, particularly as work progresses on a site, once again adding to the total cost if several permanent anchors are utilized.

SUMMARY OF THE DISCLOSURE

To this end, a solution that provides for a temporary anchor point, especially one that could be fitted to a metal roof and removed after any necessary work has been completed, would be advantageous. A useful solution to this problem, therefore, presents itself when one takes into account the typical way in which a metal roof is constructed. Typically, metal cladding is affixed with screws at intervals along a batten, which, in turn, is affixed to rafters in typical fashion. A solution is, therefore, available by simply removing sufficient screws from a section of cladding and affixing a suitable temporary anchor over the cladding by replacing the existing screws using the existing holes through the cladding. Thus, the screws would then pass through suitable holes in the temporary anchor and through the existing holes in the cladding and, thence, into the supporting structure below. Upon completion of the work, the screws can then be removed again, the temporary anchor removed, and the screws replaced once more to hold the cladding in place as it was originally affixed.

In this way, there would be no need to disturb the roof structure or cladding in any way other than to remove some of the existing screws in order to attach the temporary anchor, the screws being replaced after the necessary work on the roof has been completed and the temporary anchor has been removed.

This would provide a simple, useful and economic solution to the problem of providing a temporary anchor point for safety equipment and the like, which could then be readily removed once the work was completed. The temporary anchor could then be used at another location on the same site or taken away altogether and used on another site.

Of course, such a solution would still need to be effective in ensuring adequate safety standards are met, that is to say, the anchor itself, in conjunction with its fitment, would need to meet the necessary safety standards. It should be stressed that anchors that have hitherto been suitable for permanent fitment do not lend themselves to attachment as temporary anchors in this way.

It would, therefore, be advantageous if such a temporary anchor were not only to meet the desired safety standards, but that it were itself designed to be portable so that it could be easily taken from one work site to another.

Thus, in summary, it would be advantageous if a temporary roof anchor were available that could be affixed directly to a supporting roof structure for a metal clad roof, by affixing the anchor through the metal cladding at points already utilized for screwing the cladding to the structure, without otherwise disturbing the metal cladding itself.

It would also be further advantageous if such a roof anchor system was provided with shock-absorbing means in order to minimize injury from a person utilizing the anchor point in the event of a fall. Further, it would also be desirable if the anchor point were multi-directional to the extent that it worked efficiently no matter from which direction forces might be applied in the event of a fall.

In addition, it would also be advantageous if such an anchor could also be fitted directly to any stable structure, including the supporting structure for a tile roof, albeit with the necessity of removing some tiles or other cladding, etc., to allow access to the underlying structure where applicable.

Provided is a temporary roof anchor especially for metal clad roofs that ameliorates one or more of the abovementioned disadvantages associated with the prior art, particularly by providing a temporary anchor point that may be mounted directly over the metal roof cladding, utilizing the existing fixing points for the metal cladding itself, the anchor being so constructed as to progressively absorb the effects of a sudden load applied thereto, and wherein the anchor functions usefully in all directions.

It should also be understood that while the disclosure relates primarily to the attachment of a temporary anchor to a roof as described, it will also be applicable in many other instances where attachment of a device to another surface or structure is required, whether a wall or ceiling, for example. Thus, any reference to a roof, whether metal or otherwise, is also meant to encompass reference to any structure, where, by suitable adaptation, the device may also be utilized.

Provided is a temporary roof anchor for fitment to a roof support structure or the like, especially a roof support structure having metal cladding affixed thereto, wherein the temporary anchor is provided with a first attachment means for temporary fitment of the roof anchor to the roof support structure, a second attachment means remote therefrom for attaching devices, apparatus or equipment, especially safety equipment, thereto, and shock-absorbing means located therebetween so as to progressively distort under sudden load, and wherein the first attachment means comprises a webbing material having a plurality of spaced apart fixing points by means of which the webbing material may be affixed to the roof support structure utilizing the existing fixing means that hold the metal cladding to the roof structure.

Preferably, the shock-absorbing means is in the form of a metal bar or narrow plate, cut so as form a concertina arrangement that can progressively deform under load. Preferably, the shock absorption is provided by one or more suitably shaped portions of material cut or otherwise formed so that when a force is applied thereto, there is created a deformation therein in the form of a generally linear extension of that portion, i.e., by effectively straightening or "unbending" such region. Thus, the anchor is so designed that deformation by bending, i.e., unbending or straightening, of the shock-absorbing region, in combination with either of the attachment regions as described herein, where appropriate, provides an absorption of the forces applied to the anchor from any angle, that is to say, if a load is exerted from any direction, the anchor is able to accommodate that sudden load in suitable fashion. In this way, the anchor will provide a suitable shock-absorbing means against, for example, a sudden load arising from a person attached thereto falling from the roof.

With advantage, the shock-absorbing means in the form described may be covered with a rubber sleeve or similar covering to protect it.

This sleeve may also provide a region where safety instructions may be written.

On the other hand, any suitable shock-absorbing means may be utilized that functions to dampen the forces applied under sudden load, such as when a person attached to the roof anchor falls from the roof.

The devices, apparatus or equipment to be attached may include safety equipment such as safety harnesses, ropes or other safety devices adapted to secure a roof worker against falling and injury. While the devices, apparatus or equipment derives particular advantage when used in conjunction with a metal roof, it may also be utilized with any roof where access to the structure supporting the cladding is feasible and, accordingly, no limitation is implied by a primary reference to metal roofs in the following description.

Although any suitable attachment means may be utilized to affix safety equipment and the like, preferably, the second attachment means by which the safety equipment such as a harness, etc., is attached to the shock-absorbing means is in the form of a simple eye located near its extremity, remote from where it is attached to the roof structure, and through which the safety equipment may be attached in known fashion.

Preferably, the webbing material providing the first attachment means for affixing the anchor to the roof structure is a polyester webbing capable of supporting a high tensile load, for example, in excess of 10 tonnes. While polyester webbing is the preferred material, any webbing material, including nylon and/or composites, having the ability to with stand similar loads may be employed.

Preferably, the webbing is a single length of webbing material, although other arrangements adapted to perform as described may be utilized. Where a single length of webbing is employed, it has been found that a suitable length is around 1.5 to 2 m in length, preferably about 1.8 meters. With advantage, this length of webbing can be inserted through a slot provided in the end of the shock-absorbing means remote from the end having the means to attach the safety devices, etc., thereto. In this way, the webbing may extend for approximately equal lengths either side of the slot. By affixing the webbing to the roof structure at either side of the slot, allows for the shock-absorbing means to move to some extent between at least the first fixing points located adjacent to and either side of the slot located in the end of the shock absorber. This allows the temporary anchor to function effectively in all directions.

Preferably, the fixing points in the webbing are holes, more preferably, reinforced holes, formed in the webbing.

The preferred method of attaching the webbing to the roof structure will be by utilizing screws inserted through the holes in the webbing and into the supporting structure of the roof material. However, other forms of fixing may also be utilized, as discussed below, and no limitation should be inferred from a general reference to screws as the medium by which the webbing is attached to the roof.

Preferably, six such holes are provided in the webbing material, so as to spread the load, as described later herein. Under conditions where a fall occurs, successive screws will take the load and should the first screws adjacent the shock-absorbing means fail, successive screws will then take up the load, causing a diminishing of the forces as the fall progresses. While six holes has been found to be most preferable, other numbers of holes may be employed, although it will be appreciated they will generally be in pairs, to provide an equal number of holes either side of where the webbing attaches to the shock-absorbing means. In its most simplest form, of course, even one hole may suffice where the length of webbing is, for example, simply looped back on itself and joined. However, given that safety considerations are paramount, it is preferred to utilize additional holes to provide additional attachment points should those closest to the shock-absorbing means fail. Thus, it is preferred to have at least four holes and, more preferably, at least six, where a single length of webbing is passed through a slit in the end of the shock-absorbing means as described above.

While it is preferred that the shock-absorbing means has sufficient energy-absorbing capability so as to deform under load without allowing any of the screws to pull out, the provision of six holes, i.e., three either side of the slot in the shock absorber, provide for additional safety should the first screws adjacent the shock absorber fail. To provide added safety, six, rather than merely four screws, are recommended.

With advantage, the holes in the webbing are provided with metal reinforcements in the form of metal eyelets formed through the web. It is preferred that the holes be formed in the webbing material by spreading the fibers apart rather than cutting through the webbing. On the other hand, any means by which holes are formed may be contemplated. Compensation for reduced strength may be made by widening the amount of material in the webbing, for example. In any event, the metal eyelets then provide suitable reinforcement for such holes through which screws may be fitted, the screws then passing through the original holes in the metal cladding and into the support structure. The metal eyelets protect the webbing when inserting the screws and provide a reinforcement so the head of the screw is constrained from passing through the webbing, either during insertion of the screw or subsequently, should the temporary anchor be subjected to a sudden fall from a person attached thereto.

Conventionally, eyelets are formed by utilizing a two-part construction, there being a male portion and a female portion, such that the male portion has a tubular portion that extends through the hole and is pressed over, i.e., crimped or expanded over, the female portion on the other side, forming a flange after the tubular portion passes through the hole in the female portion.

However, as the webbing required for the invention is of necessity one having a very robust construction, conventional eyelets have been found to be inadequate, generally inadequate especially where relatively thick webbing material is utilized, e.g., greater than about 3 mm in thickness. Again, however, where suitable compensation is otherwise made by, for example, using broader webbing to compensate for a narrower thickness, conventional eyelets may be employed.

In relation to the preferred webbing structure, however, having a thickness in excess of, say, 3 mm, a simple alternative has been developed that involves the use of a three-part eyelet assembly, comprising two identical washers placed either side of the hole with a ferrule passing therethrough, each end of which is then caused to be pressed over both washers, i.e., forming flanges from both sides, in the same way as the tubular portion of a conventional eyelet is pressed on one side as described above, but in this case, doubled here to form each side of the eyelet structure.

With advantage, this eyelet, according to the invention, can be inserted in such heavy webbing material by having a series of spikes mounted along a supporting member, over which the webbing can be forced to first create the required holes by spreading the fibers rather than cutting them. With a washer already located below the hole, i.e., on each spike, it is then a simple matter to slide the ferrule down the spike and force it through the hole, and fit another washer over each spike. A simple press arrangement then squeezes from each side, causing each end of the ferrule to foam a flange on either side, which then binds each washer to each side of the respective holes formed in the web, creating an effective three-part metal eyelet having greater robustness than is attainable from a two-part eyelet assembly.

Thus, in typical applications where metal sheeting is affixed to a roof structure with existing screws, when affixing the temporary anchor, the screws that hold the metal cladding are simply removed, the temporary anchor located in position and then held in place utilizing those or other screws if necessary, by inserting the screws through the holes in the webbing, then passing through the original holes in the metal cladding and thence into the supporting structure, generally a batten. Once the work is completed, the screws may then be removed again, the temporary anchor taken away and the screws refitted to hold the metal cladding in the way it was originally found.

It is, of course, necessary that the screws hold the temporary anchor firmly and to this extent, a different length of screw (albeit with the same gauge) may need to be utilized to ensure proper penetration into the underlying batten. In the case of a timber batten, it has been found that the screws should penetrate at least 35 mm into the batten. Similarly, it is necessary with metal battens that the screw thread engages properly with the batten to avoid so-called overpassing of the thread as most roofing screws have a blank or unthreaded region below the head of the screw.

On the other hand, the disclosure is not meant to be limited to the use of screws as aforementioned and any suitable fixing means may be employed, either by affixing to the underlying roof structure through existing holes or even to the roof sheeting itself, provided the fixing of the sheeting to the underlying structure is sufficiently sound and the means by which the webbing is attached to the sheeting or structure is sufficient to withstand the forces discussed above.

In this regard, for example, so-called Klip Lock roofs do not have holes therethrough but are otherwise "clipped" down. By suitable adaptation, other fixing means that allow the webbing to be attached to such sheeting are, therefore, meant to be within the scope of the invention.

By utilizing a webbing material, having as its major advantage complete flexibility, it will be understood that a variety of metal cladding profiles may thus be accommodated, the excess material between each fixing point, i.e., hole, simply allowed to form a loop between each fixing point. In other words, the use of webbing material allows for simple adjustment to accommodate different profiles of metal cladding and different spacings of screws placed therein, while still providing adequate support for the temporary anchor if subjected to a sudden load.

Alternatively, where the roof support structure supports other than metal cladding, the webbing material may be affixed instead directly to the roof support structure after sufficient roof covering material, for example, tiles, has been removed, In such cases, the screws should be fitted preferably at least 100 mm apart along a rafter or batten. Therefore, although primarily intended for use with a metal roof, the temporary anchor, according to the invention, could be fitted to a tiled roof or any other suitable stable structure, by attaching directly to the supporting structure, such as a rafter or batten, after removing one or more tiles as necessary to gain access to the underlying support structure.

Preferably, the webbing and the way in which it is affixed to the roof support structure and/or the roof cladding as described herein, co-operate with the shock-absorbing means to further assist in minimizing the forces experienced should a fall occur.

It will be understood from the embodiments described herein, that the design as described herein is able to function, irrespective of the direction of the load.

BRIEF DESCRIPTION OF THE DRAWINGS

The invention will be better understood from the following non-limiting description of various aspects of an embodiment of the invention with reference to the drawings in which.

DETAILED DESCRIPTION OF THE ILLUSTRATED EMBODIMENTS

Figure 1:
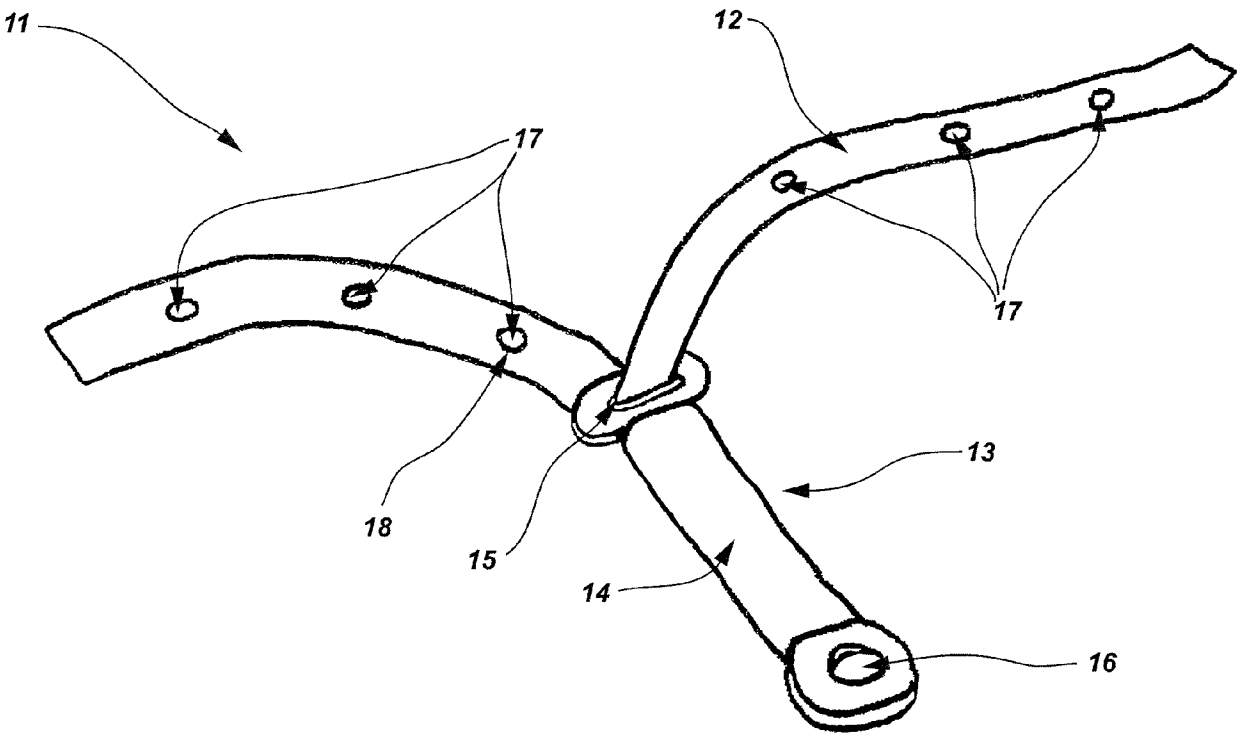
FIG. 1 is a perspective view of a temporary roof anchor according to one embodiment of the invention.

Referring generally to FIG. 1, there is shown a roof anchor generally referenced 11 according to one embodiment. The roof anchor 11 comprises a first attachment in the form of a flexible webbing material 12 and a shock absorber 13. Shock absorber 13 (shown in detail in FIG. 2) is sheathed in a rubber or latex sleeve 14 or similar sleeve. Extending from one end of the shock absorber 13 is a slot 15 through which the length of webbing 12 is inserted. The other end of the shock absorber 13 is provided with a hole 16 to which safety devices such as a harness or rope (not shown) may be attached.

The webbing is provided with six holes 17 spaced along its length at approximately 300 to 400 mm centers. The holes 17 are preferably formed by piercing the webbing 12 to separate the fibers, rather than cutting a hole in the webbing 12 itself, which would weaken the webbing 12 at that point. These holes 17 are further provided with metal eyelets generally referenced 18 to provide reinforcement. The construction of each eyelet 18 is shown in detail in FIG. 3.

Figure 5:
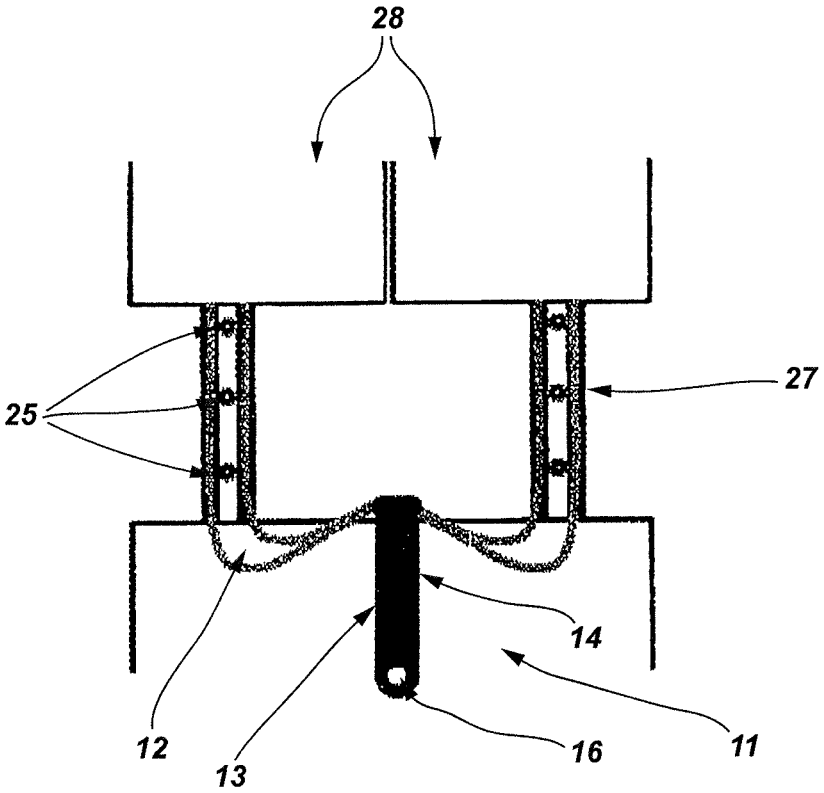
FIG. 5 is a simple plan view of a temporary roof anchor shown in FIG. 1 attached to the rafters of a tiled roof after removal of tiles.
Figure 4:
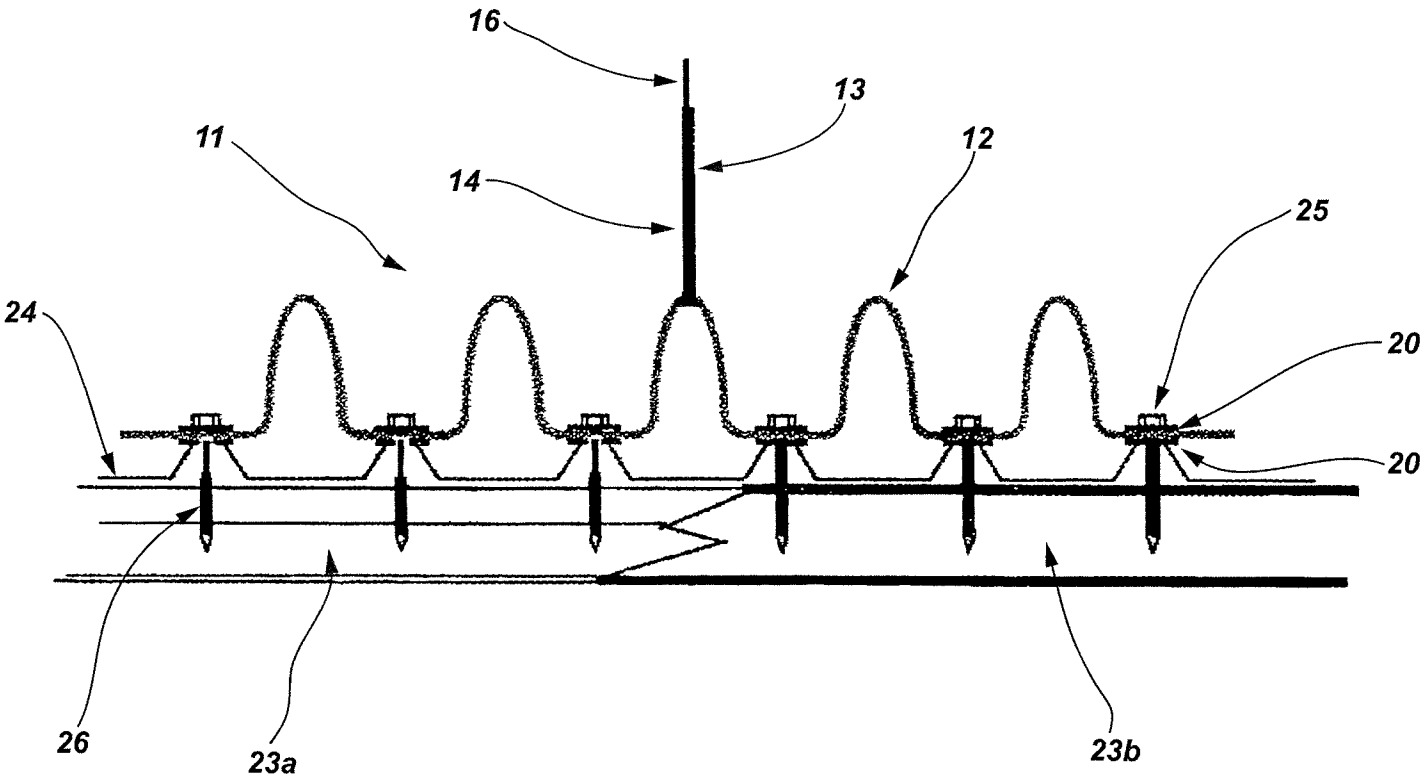
FIG. 4 is a schematic side elevation of a temporary roof anchor shown in FIG. 1 showing it affixed to a metal or timber batten supporting a metal roof cladding.

The holes 17 allow for fixing the temporary anchor 11 to a roof structure as shown in FIGS. 4 and 5.

Figure 2:
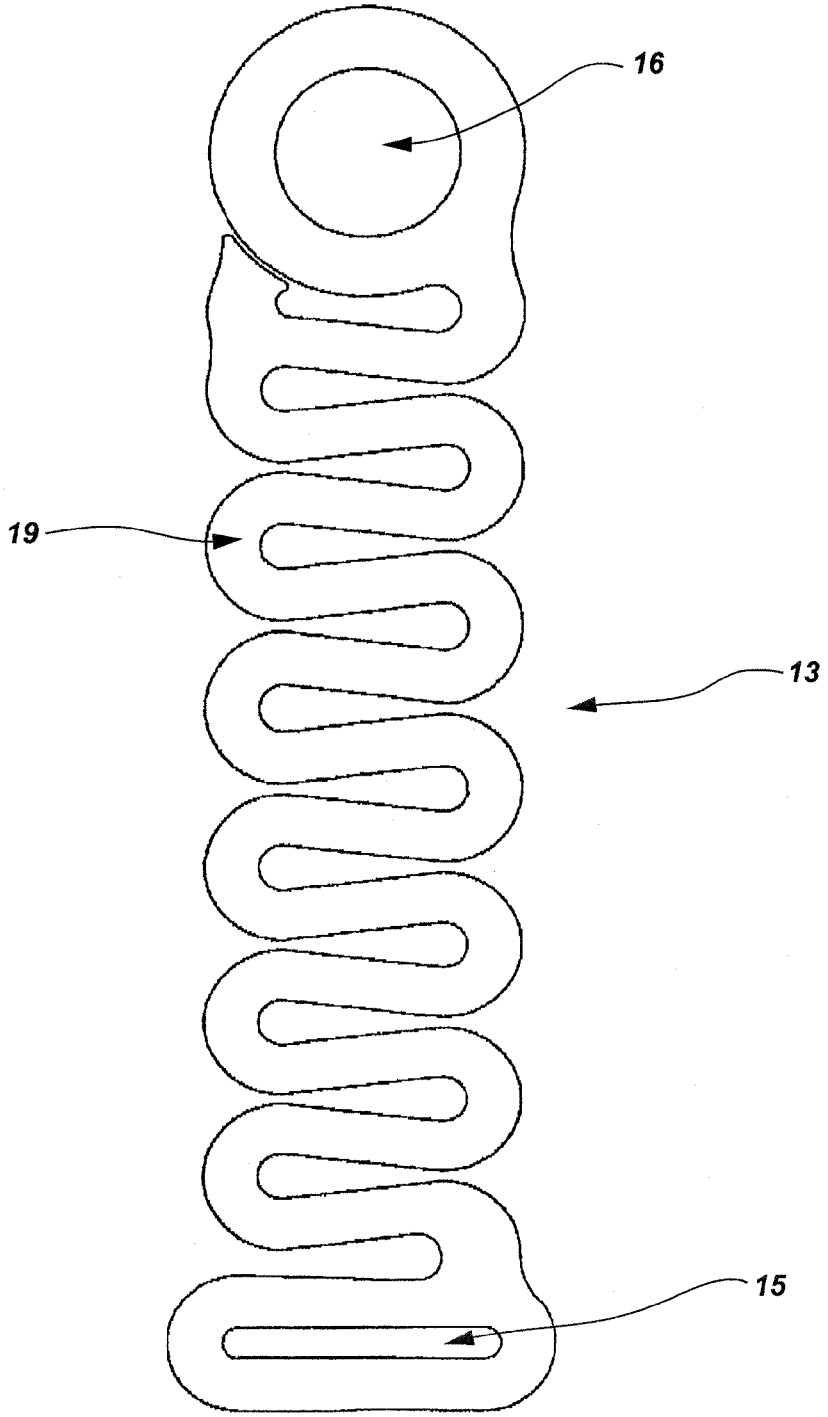
FIG. 2 is a plan view of a suitable energy-absorbing shock absorber for use in the roof anchor shown in FIG. 1.

Referring to FIG. 2, there is shown in detail the shock absorber 13, which is made from a sheet of stainless steel, e.g., 3 mm thick, die out to produce the aforementioned slot 15 at one end for receiving a length of webbing 12 and a hole 16 at the other end to which safety devices such as harnesses and the like may be attached. Therebetween is a region of concertina-like bends, generally referenced 19, formed by die cutting. Upon experiencing a sudden load, such as would occur when a person attached to the temporary roof anchor 11 of which this shock absorber 13 is a part, the shock absorber 13 is caused to extend by, as it were, "unbending," i.e., concertina region 19 straightening out. This action provides for a cushioning of the initial load when it is first applied, thereby effectively diminishing the energy of the load as the deformation progresses.

The sleeve 14 described above protects the shock absorber 13 and may also be usefully used to display safety instructions, etc.

Figure 3:
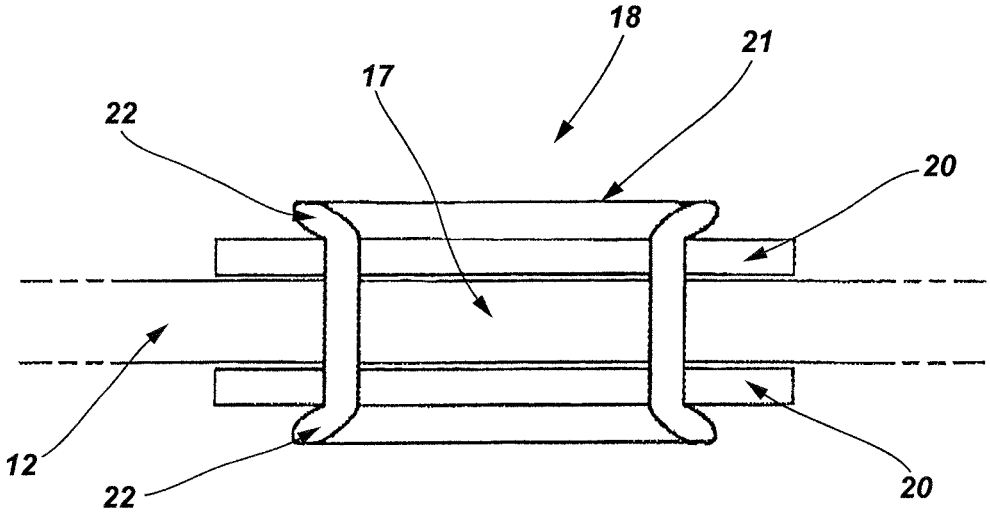
FIG. 3 is cross-sectional side elevation showing a detail of the eyelet for use in the temporary anchor shown in FIG. 1.

Referring to FIG. 3, there is shown a three-piece metal eyelet configuration, generally referenced 18, as used in the temporary anchor of FIG. 1. The eyelet 18 comprises two washers 20, which are caused to be pressed against either side of a hole 17 extending through a portion of webbing material 12 as described above. A ferrule member 21 is located through the hole 17 in the webbing 12 and by means of a press (not shown) has been bent at each end to form flanges 22, which secures the eyelet assembly 18 in place, thereby reinforcing the hole 17. The metal construction of the eyelet 18 not only provides stability to the holes 17 formed by separating the fibers as described above, but also protects each hole 17 formed in the webbing 12, e.g., when inserting a screw therein (as shown in FIGS. 4 and 5), and, furthermore, also maintains the integrity of the webbing 12 in use so that it will not pull away from the head of the screw once fitted to a roofing structure.

Referring then to FIG. 4, there is shown schematically a temporary anchor 11 as described in FIGS. 2 through 3, attached to a roofing structure, in this case a batten 23 supporting a sheet of metal roof cladding 24. Batten 23 is shown schematically as both a metal batten 23*a* and a timber batten 23*b*. In each case, however, suitable hex-headed roofing screws 25 have been utilized, as is the norm. It is generally preferred that the screws in the timber batten 23*b* extend at least 35 mm into the batten 23, while in the case of the metal batten 23*a*, it is necessary to ensure that the threaded portion 26 of the screw 25 engages in the hole of the batten 23*a* without over extending as described earlier.

In either case, screws 25, which initially secured the roof cladding 24 to the respective batten 23*a*, 23*b*, have been removed and replaced after the temporary anchor 11 has been located thereon. Either the original screws 25 have been utilized or other screws 25 of the same gauge but of an appropriate length as described have been used.

The length of webbing 12 is allowed to simply "buckle up" or concertina along its length between respective screw attachment points.

With reference to FIG. 5, there is shown an attachment of a temporary roof anchor 11 to a pair of rafters 27, which have been exposed after a suitable number of tiles 28 have been removed. In this instance, it is preferred that the screws 25 be located at least 100 mm apart.

In either case, as illustrated in FIG. 4 or FIG. 5, if a sudden load is applied to the temporary anchor 11 as would occur from a person attached thereto falling from the roof, the bulk of the energy absorption will be initially taken up by the shock absorber 13 as it "unbends" as described above. If, for any reason, the first pair of screws 25 fail, the load will be progressively taken up by the next pair of screws 25, all the while the energy being dissipated as the fall, and hence the shock absorption, progresses. The provision of six screw holes 17 in the webbing 12 is to provide additional safety against failure.

Should the temporary anchor 11 be used in a fall, then it should be discarded. Otherwise, it may be removed by undoing the screws 25, taken away and, in the case of a metal roof as shown in FIG. 4, the original screws reinserted in the existing locations to once again secure the roof, or in the case of the tile roof shown in FIG. 5, the tiles placed back in position.

It will appreciated that many modifications and variations may be made to the embodiment described herein by those skilled in the art without departing from the spirit or scope of the disclosure.

Throughout the specification and claims the word "comprise" and its derivatives are intended to have an inclusive rather than exclusive meaning unless the context requires otherwise.

It will be immediately apparent to persons skilled in the art that the temporary roof anchor may provide an anchor point for a variety of activities carried out on roofs. For example, the roof anchor may provide a temporary anchor point for posts supporting fences or other barriers erected for the safety of workmen working on the roof or may be used to secure equipment associated with the actual work on the roof, notwithstanding that its primary function is to provide safety for persons engaged on working on a roof.

What is claimed is:

1. A temporary roof anchor for fitting to a roof support structure, the temporary roof anchor comprising:

flexible first attachment adjustable to affix the roof anchor to a plurality of fixing points on the roof support structure for temporary fitment to the roof support structure;

second attachment remote from the flexible first attachment means for attaching safety equipment; and shock-absorbing means having a deformable region extending in-between the flexible first attachment and second attachment, wherein the flexible first attachment, or a part thereof, is able to bend back on itself to form a loop or section of a loop, and wherein the flexible first attachment includes a plurality of holes adapted to be affixed to the fixing points.

2. The temporary roof anchor of claim 1, wherein the deformable region comprises a concertinaed arrangement.

3. The temporary roof anchor of claim 1, wherein the deformable region is formed so that when a critical sudden load is applied thereto, the deformation region unbends.

4. The temporary roof anchor of claim 1, wherein a critical sudden load is applied to the roof anchor when a person attached to the safety equipment falls from a height.

5. The temporary roof anchor of claim 1, wherein the deformation region is covered with a sleeve to protect it in normal use until subject to the critical sudden load.

6. The temporary roof anchor of claim 1, wherein the flexible first attachment comprises a flexible webbing.

7. The temporary roof anchor of claim 1, wherein the second attachment comprises an eye for attachment of the safety equipment.

8. A temporary roof anchor for fitting to a roof support structure, the roof anchor comprising:

a flexible first attachment for temporary fitting to a roof support structure;

a second attachment, remote from the flexible first attachment, for attaching equipment thereto; and a shock absorber having a deformable region that extends in-between the flexible first attachment and the second attachment at a first length when the shock absorber is not subject to a deformation force corresponding to a critical sudden load, wherein the shock absorber lies substantially in a single plane and comprises a substantially rigid structure that, when subject to a critical sudden load, deforms, elongating to a length greater than the first length.

9. The temporary roof anchor of claim 8, wherein the deformable region has a concertinaed arrangement.

10. The temporary roof anchor of claim 9, wherein the concertinaed arrangement comprises a plurality of uniform folds, the uniform folds disposed next to each other in a generally linear configuration.

11. The temporary roof anchor of claim 8, wherein the critical sudden load is applied when a person attached thereto falls from a height.

12. The temporary roof anchor of claim 8, wherein the deformable region is covered with a sleeve to protect it in normal use until subject to the critical sudden load.

13. The temporary roof anchor of claim 8, wherein the flexible first attachment comprises a flexible webbing.

14. The temporary roof anchor of claim 8, wherein the second attachment comprises an eye for attachment of the safety equipment thereto.

15. The temporary roof anchor of claim 1, wherein the deformable region comprises a serpentine arrangement.

16. The temporary roof anchor of claim 1, wherein each hole of the plurality of holes is formed by separating the fibers of the webbing, not by cutting the webbing fibers.

17. The temporary roof anchor of claim 1, wherein each hole of the plurality of holes is reinforced by a metal eyelet assembly.

18. The temporary roof anchor of claim 1, wherein the webbing is inserted through a slot in an end of the shock absorber means remote from the second attachment.

19. The temporary roof anchor of claim 1, wherein the shock absorber means is formed from a single metal sheet.

20. The temporary roof anchor of claim 1, wherein the shock absorbing means includes a concertina arrangement.

21. The temporary roof anchor of claim 18, wherein the shock absorber comprises a planar metal piece die cut from a single sheet and comprising a plurality of concertina-like bends extending between the slot and the second attachment and adapted to unbend on application of a critical sudden load.

* * * * *